US007881157B2

(12) United States Patent
Watabe et al.

(10) Patent No.: US 7,881,157 B2
(45) Date of Patent: Feb. 1, 2011

(54) PRESSURE WAVE GENERATOR AND PRODUCTION METHOD THEREFOR

(75) Inventors: Yoshifumi Watabe, Tondabayashi (JP); Yoshiaki Honda, Souraku-gun (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 358 days.

(21) Appl. No.: 12/066,646

(22) PCT Filed: Oct. 19, 2006

(86) PCT No.: PCT/JP2006/320818

§ 371 (c)(1),
(2), (4) Date: Mar. 12, 2008

(87) PCT Pub. No.: WO2007/049496

PCT Pub. Date: May 3, 2007

(65) Prior Publication Data

US 2009/0145686 A1 Jun. 11, 2009

(30) Foreign Application Priority Data

Oct. 26, 2005 (JP) ..... 2005-312013

(51) Int. Cl.
*H04R 23/00* (2006.01)
*B06B 1/00* (2006.01)

(52) U.S. Cl. ..... 367/140; 381/164

(58) Field of Classification Search ..... 367/140; 381/164

See application file for complete search history.

(56) References Cited

U.S. PATENT DOCUMENTS

2005/0201575 A1* 9/2005 Koshida et al. ..... 381/164
2007/0217289 A1 9/2007 Watabe et al.

FOREIGN PATENT DOCUMENTS

EP 1 215 936 A2 6/2002
EP 1 761 105 A1 3/2007
JP 11-300274 A 11/1999
JP A-11-300274 * 11/1999
JP 2005-269745 A 9/2005
WO WO-2005/107318 A1 11/2005

OTHER PUBLICATIONS

International Search Report for the Application No. PCT/JP2006/320818 dated Nov. 28, 2006.

(Continued)

*Primary Examiner*—Ian J Lobo
(74) *Attorney, Agent, or Firm*—Cheng Law Group, PLLC

(57) ABSTRACT

A pressure wave generator is provided, which has excellent output stability over time. This pressure wave generator comprises a substrate, a heat generating layer, and a heat insulating layer formed between the substrate and the heat generating layer. A pressure wave is generated in a surrounding medium (air) by a change in temperature of the heat generating layer, which is caused upon energization of the heat generating layer. The heat insulating layer comprises a porous layer and a barrier layer formed between the porous layer and the heat generating layer to prevent diffusion of reactive substances such as oxygen and moisture in the air and impurities into the porous layer. By the formation of the barrier layer, it is possible to prevent a reduction in output of the pressure wave generator caused by a change over time of the porous layer.

16 Claims, 5 Drawing Sheets

OTHER PUBLICATIONS

Supplementary European Search Report for the Application No. EP 06 81 2006 dated Jun. 30, 2009.

Shinoda, H. et al., "Thermally Induced Ultrasonic Emission From Porous Silicon", Nature, Aug. 1999, vol. 400, No. 6747, pp. 853-855.

* cited by examiner

PRESSURE WAVE GENERATOR AND PRODUCTION METHOD THEREFOR

TECHNICAL FIELD

The present invention relates to a pressure wave generator, which is preferable in applications such as speaker and ultrasonic sensor, and a production method for the same.

BACKGROUND ART

In the past, an ultrasonic wave generator using mechanical vibrations due to the piezoelectric effect has been widely known. As this kind of ultrasonic wave generator, for example, there is a structure where electrodes are formed on both surfaces of a crystal of a piezoelectric material such as barium titanate. The mechanical vibrations obtained by applying an electric energy between the electrodes generate the ultrasonic wave in a surrounding medium (e.g., air). However, since the above-mentioned ultrasonic wave generator has a characteristic resonance frequency, there are problems that the frequency band becomes narrow, and it is susceptible to external vibrations or fluctuations of outside air pressure.

On the other hand, in recent years, a pressure wave generator capable of generating a pressure wave such as ultrasonic wave in a medium without using mechanical vibrations is attractive. For example, a pressure wave generator disclosed in Japanese Patent Early Publication No. 11-300274 is equipped with a single crystal silicon used as a substrate, a porous silicon layer formed as a heat insulating layer on the substrate, an aluminum film formed as a heat generating layer on the heat insulating layer, and a pair of pads electrically connected to the heat generating layer. In this pressure wave generator, when an electric energy is applied to the heat generating layer through the pads, a temperature change occurs in the heat generating layer in response to a driving input waveform, i.e., a driving voltage waveform or a driving current waveform. This temperature change of the heat generating layer causes, through a heat exchange between the heat generating layer and a medium (e.g., air) in the vicinity of the device, expansion and contraction of the medium in a thermally induced manner. As a result, the pressure wave is generated in the medium.

However, in the case of using this kind of thermally induced type pressure wave generator in the air, it is known that there is a phenomenon that an efficiency defined as a ratio of sound pressure of the generated compression wave relative to the input power reduces over time. That is, when oxidation of the porous silicon layer proceeds by the influence of oxygen and moisture in the air, the heat insulating property of the porous silicon layer deteriorates, so that a reduction in the aforementioned efficiency happens.

In this regard, when it is assumed that a condition for driving the above pressure wave generator (i.e., an input power applied to the heat generating layer) is constant, the sound pressure of the generated compression wave reduces due to an increase over time in heat conductivity of the heat insulating layer or an increase over time in heat capacity per unit volume thereof. Therefore, when the pressure wave generator is used as a wave sending device for a reflection-type ultrasonic sensor, the maximum measurable distance reduces (i.e., the detection area becomes narrow). As a result, there is a case that an object can not be detected. In addition, when the pressure wave generator is used as a speaker, there is a problem that the sound pressure reduces. The above-described change over time of the porous silicon layer is a phenomenon caused irrespective of conditions for forming the porous silicon layer.

In addition, since the heat generating layer that is an electrical resistive element is formed on the porous silicon layer, the heat generating layer partially reacts with the porous silicon layer when the pressure wave generator is used for an extended time period, so that a leak current may locally flow through a resistance reduced portion. Furthermore, when a conductive path is formed through the silicon substrate, an electric current having a very large current density locally flows. This phenomenon easily happens in the case of increasing the input power applied to the pressure wave generator to obtain a large sound pressure. As a result, the pressure wave generator may have a breakdown due to burn out of the heat generating layer.

In the above, it was explained about the case characteristics of the heat insulating layer of porous silicon deteriorate due to a reaction with oxygen in the air. On the other hand, even when the heat insulating layer is made of an inactive material such as porous silica and porous alumina, it is expected that a change over time in heat conductivity or heat capacity per unit volume of the heat insulating layer is caused by adsorption or adherence of the moisture in the air and the other impurities.

Thus, from the viewpoint of solving various kinds of defects caused by diffusion of components (principally air) of the surrounding medium into the heat insulating layer, conventional pressure wave generators still have plenty of room for improvement.

SUMMARY OF THE INVENTION

Therefore, in consideration of the above problems, a primary concern of the present invention is to provide a pressure wave generator capable of preventing a reduction in output caused by a change over time of a heat insulating layer.

That is, the pressure wave generator of the present invention comprises a substrate, a heat generating layer, and a heat insulating layer formed between the substrate and the heat generating layer. The pressure wave generator is configured to generate a pressure wave in a surrounding medium by a change in temperature of the heat generating layer, which is caused upon energization of the heat generating layer. The heat insulating layer comprises a porous layer and a barrier layer formed between the porous layer and the heat generating layer to prevent diffusion of a component of the medium into the porous layer.

According to the present invention, since the heat insulating layer has the barrier layer formed on the porous layer at a side facing the heat generating layer, it is possible to prevent deterioration of thermal properties, which is caused when reactive substances such as oxygen and moisture in the surrounding medium (e.g., air) and impurities are diffused into the porous layer, adsorbed or adhered to the porous layer, or reacted with the porous layer. As a result, a reduction in output caused by a change over time of the heat insulating layer can be suppressed.

In the above pressure wave generator, it is preferred that the barrier layer is formed by expanding the volume of a part of the porous layer, and has a structure where at least one of porosity and average pore diameter of the barrier layer is smaller than that of the porous layer.

In this case, oxygen and moisture in the air are hard to diffuse into the porous layer due to the presence of the barrier layer. Therefore, it is possible to prevent an increase in heat conductivity or heat capacity per unit volume derived from the adsorption or adherence of oxygen and moisture as well as the change in thermal properties of the porous layer. In addition, since the barrier layer is integrally formed with the porous layer, a good quality interface structure can be obtained therebetween. When the porosity of the barrier layer is low (i.e., the number of pores is small, or the pore diameter is small, or both of them are small), it is possible to improve the mechanical strength of the barrier layer, and obtain an effect of preventing breakage of a skeleton of the porous layer. Particularly, when the porous layer is formed by porous silicon, which is lower in mechanical strength than single crystal silicon, the porous silicon layer is effectively reinforced by the barrier layer. Even when the porosity of the barrier layer is substantially the same as that of the porous layer, the same effect can be expected despite an increase in the number of pores on the condition that the average pore diameter of the barrier layer is smaller than that of the porous layer When the barrier layer formed by expanding the volume of the part of the porous layer has a porous structure, it has a structure where at least a part of pores of the porous layer are communicated with pores of the barrier layer. On the other hand, when the barrier layer has a dense structure having substantially no void, it functions as a pore sealing layer for sealing the pores of the porous layer.

In the present invention, it is preferred that the porous layer is made of silicon, and the barrier layer comprises a silicon compound. In this case, after the porous silicon layer is formed, the barrier layer can be formed by oxidizing a surface layer portion of the porous silicon layer with oxygen or moisture, carbonizing the surface layer portion through a reaction with a carbon containing substance, or nitriding the surface layer portion through a reaction with a nitrogen containing substance. In addition, since the barrier layer of this case is formed by the silicon compound having chemical stability such as silicon oxide, silicon carbide and silicon nitride, the advantages of the barrier layer can be stably maintained over an extended time period.

In addition, from the viewpoint of preventing a reduction in efficiency (P/Q) which is defined as a ratio of generated sound pressure "P" relative to input power "Q", it is preferred that a thickness of the barrier layer is equal to or smaller than a thermal diffusion length (m) determined by $(2\alpha i/\omega Ci)^{1/2}$, wherein "$\alpha i$" is thermal conductivity of the barrier layer, "Ci" is thermal capacity ($J/(m^3 \cdot K)$) per unit volume of the barrier layer, and when a driving input waveform applied to the heat generating layer is a sine wave, and a frequency "f" (Hz) of temperature fluctuations of the heat generating layer is equal to twice as large as a frequency of the sine wave, angular frequency of the temperature fluctuations of the heat generating layer is represented as "$\omega=2\pi f$ (rad/s)". In this case, by reducing a heat amount depleted by the barrier layer with respect to Joule heat generated in the heat generating layer by an electric input, a high heat insulating property of the porous layer positioned under the barrier layer can be effectively utilized. As a result, it is possible to keep sound-wave generation efficiency at a high level.

In addition, it is preferred that at least one of the porous layer and the barrier layer is made of an electrically insulating material. In this case, since a local electrical leakage path is not formed between the heat generating layer and the heat insulating layer even after the use for an extended time period, it is possible to provide the pressure wave generator with high operation reliability, which has the capability of stably generating the pressure wave with increased sound pressure. As the electrically insulating material, for example, it is preferred to use a silicon compound such as silicon oxide, silicon carbide and silicon nitride, and particularly silica, which can be formed on a large area substrate in a lump sum by means of painting or a vapor deposition method such as CVD. Therefore, a reduction in cost of the pressure wave generator can be achieved. In addition, there is an advantage of easily realizing a large-scale speaker and an ultrasonic wave generator having a directionality characteristic by phase control.

In addition, it is preferred that an inert gas is filled in the porous layer. Alternatively, it is preferred that an interior of the porous layer is held at a reduced pressure atmosphere. In this case, it is possible to further reduce the probability that reactive substances such as oxygen and moisture in the air is adsorbed or adhered to the porous layer.

A further concern of the present invention is to provide a method of producing the pressure wave generator, which comprises the step of forming the barrier layer suitable to achieve the above-described purpose. That is, the production method of the present invention is characterized by comprising the steps of forming a porous layer on the substrate, forming, on the porous layer, the barrier layer for preventing diffusion of a component of the medium into the porous layer, and forming the heat generating layer on the barrier layer.

A preferred embodiment of the step of forming the porous layer comprises the sub-steps of performing an anodizing treatment to the substrate to form a first porous layer over a depth from a surface of the substrate, and then performing the anodizing treatment to the substrate under a different condition to form a second porous layer adjacent to the first porous layer in the substrate. The conditions of the anodizing treatment are determined such that the first porous layer has a structure where at least one of porosity and average pore diameter of the first porous layer is smaller than that of the second porous layer. In this case, two kinds of porous layers, which are different from each other in at least one of porosity and average pore diameter, can be formed by changing only the conditions of the anodizing treatment. In addition, it is possible to obtain a good quality interface between the porous layers. In this case, the first porous layer provides the basis of the barrier layer formed at the subsequent step.

In the case of using the anodizing treatment to form the porous layer, the condition of the anodizing treatment may be determined such that at least one of porosity and average pore diameter of the porous layer is gently increased in a depth direction from a surface of the substrate. In this case, the surface layer portion of the porous layer provides the basis of the barrier layer formed at the subsequent step.

As the step of forming the barrier layer, it is preferred that the barrier layer is formed by expanding the volume of a part of the porous layer having excellent heat insulating property and formed on the substrate. That is, the apparent volume of the skeleton of the porous layer is increased by physically or chemically modifying the part of the porous layer, so that a structure for preventing gas diffusion into the interior is formed at the surface layer portion of the porous layer. Specifically, it is preferred to heat the part of the porous layer in the presence of at least one of oxidizing gas, carbonizing gas and nitriding gas. In this case, since the skeleton volume of the part of the porous layer is increased by oxidation, carbonization or nitrization, the barrier layer such as oxide, carbide and nitride with chemical stability can be obtained.

Alternatively, the barrier layer may be formed by electrochemically oxidizing a part of the porous layer in an electrolyte solution. In particular, when the above-mentioned anodizing treatment is used to form the porous layer, the barrier layer can be formed by changing only the electrolyte solution with use of the same treatment apparatus. Therefore, a reduction in production cost can be achieved.

In the production method according a further preferred embodiment of the present invention, the step of forming the porous layer comprises the sub-steps of forming a first porous layer over a depth from a surface of the substrate, and then forming a second porous layer adjacent to the first porous layer in the substrate such that at least one of porosity and average pore diameter of the second porous layer is larger than that of the first porous layer. On the other hand, the step of forming the barrier layer comprises a treatment of reducing at least one of porosity and average pore diameter of the first porous layer. In this case, the barrier layer is formed by performing the treatment for reducing at least one of the porosity and average pore diameter to the first porous layer, which is smaller in at least one of porosity and average pore diameter than the second porous layer. Therefore, it is possible to more effectively prevent that oxygen and moisture in the air are diffused into the second porous layer. As the aforementioned treatment, it is preferred to perform a treatment of expanding the volume of at least a part of the first porous layer.

In place of the volume expansion treatment described above, the barrier layer may be formed by melting a part of the porous layer by means of laser heating. A dense structure is formed at the surface layer portion of the porous layer by means of heat melting to seal the interior of the porous layer. In addition, when the laser heating treatment is performed in an inert gas atmosphere or a reduced pressure atmosphere, it is possible to maintain interior of the porous layer in an inert gas filled state or a reduced pressure state, and therefore shield the interior of the porous layer from oxygen and moisture in the air.

BEST MODE FOR CARRYING OUT THE INVENTION

The pressure wave generator and the production method of the present invention are explained below in detail according to preferred embodiments, referring to the attached drawings.

Figure 1:
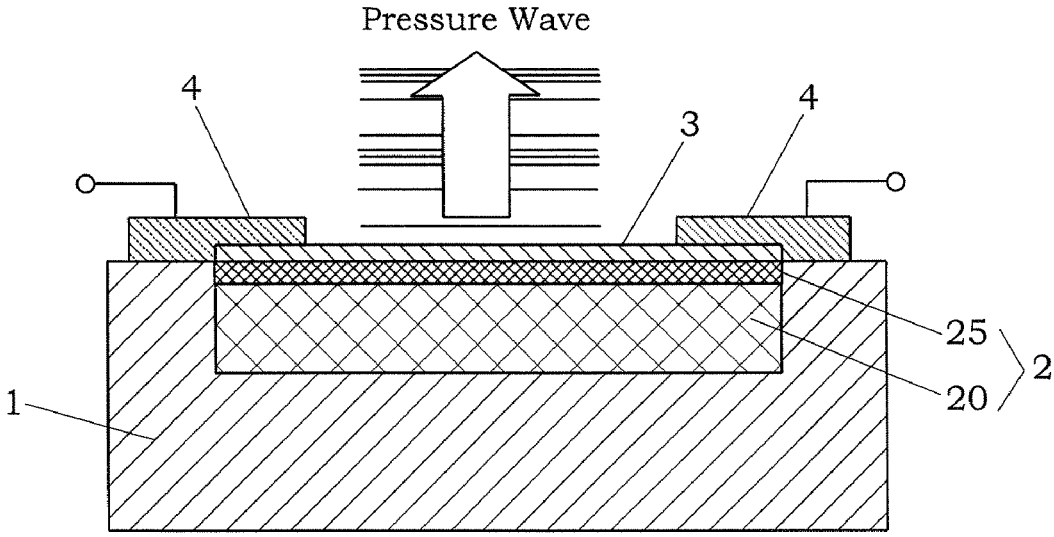
FIG. 1 is a schematic cross-sectional view of a pressure wave generator according to a preferred embodiment of the present invention.

As shown in FIG. 1, the pressure wave generator of the present embodiment has a substrate 1 made of single crystal silicon, a heat generating layer 3 formed by a metal thin film, a heat insulating layer 2 formed between the substrate 1 and the heat generating layer 3, and a pair of pads 4 formed on both end portions of the heat generating layer 3. A change in temperature of the heat generating layer 3 caused upon energization of the heat generating layer 3 through the pair of pads 4 gives a thermal shock to the air of the surrounding medium to generate a pressure wave. In the present embodiment, since a driving voltage waveform or a driving current waveform is applied to the heat generating layer 3, the temperature change occurs in the heat generating portion 3 in response to this driving input waveform. This temperature change of the heat generating layer 3 causes, through a heat exchange between the heat generating layer and the medium (e.g., air) in the vicinity of the generator, expansion and contraction of the medium in a thermally induced manner. As a result, the pressure wave is generated in the medium. An insulating film (not shown) of a silicon oxide film is formed on a region not having the heat insulating layer 2 of the top surface of the substrate 1.

A material used for the substrate 1 is not limited to a specific one. When a porous layer is integrally formed in the substrate by an anodizing treatment described later, it is preferred to use a semiconductor material such as Si, Ge, SiC, GaP, GaAs, and InP. For example, when the substrate 1 is made of Si, a single crystal silicon substrate, a polycrystalline silicon or an amorphous silicon substrate can be used as the substrate 1. In addition, a p-type or n-type doped Si substrate may be used. There is no limitation with respect to surface orientation of the crystal. In the present embodiment, a p-type single crystal silicon substrate is used as the substrate 1.

As the heat generating layer 3, it is possible to use a high melting point metal material such as iridium, tantalum, molybdenum, and tungsten. In addition, when high sound pressure is not needed, a noble metal material such as platinum, palladium and gold, which is not deteriorated by oxidation, may be used. In the present embodiment, the heat generating layer 3 is made of iridium, which is the high-melting point metal material as well as the noble metal material. In addition, as a material used for the pads 4, an electrical conductive material can be used. In the present invention, the pads 4 are made of aluminum.

The heat insulating layer 2 of the present embodiment is composed of a porous layer 20 and a barrier layer 25 formed between the porous layer 20 and the heat generating layer 3. The barrier layer 25 is formed to prevent diffusion of reactive substances such as oxygen and moisture in the air into the porous layer 20, and preferably shield the porous layer 20 from the outside air. By the formation of this barrier layer 25, even when the pressure wave generator is used for an extended time period in an environment having oxygen and the reactive substances, it is possible to prevent deterioration in heat insulating property of the porous layer, and therefore provide the pressure wave generator, which exhibits excellent output stability over time.

It is preferred that the porous layer 20 is made of the same material as the substrate 1, or a material having higher heat insulating property than the substrate 1. On the other hand, a material for the barrier layer 25 is not limited on the condition that the diffusion of moisture and contaminators into the porous layer 20 can be prevented. However, as described later, it is preferred that the porous layer 20 is formed by making a part of the substrate 1 porous, and particularly the barrier layer 25 is formed by use of a part of the thus obtained porous layer 20. As an example, the porous layer 20 can be formed by porous silicon, which is obtained by malting the silicon substrate 1 porous, and the barrier layer 25 can be formed by performing a volume expansion treatment described later to a part of the porous silicon layer.

By the way, to achieve the purpose of the present invention, it is not essential that the barrier layer 25 has a completely dense structure. The barrier layer 25 may have a porous structure satisfying the following conditions. That is, when "Ps" is porosity of the porous layer 20, "Rs" is average pore diameter of the porous layer 20, "Pi" is porosity of the barrier layer 25, and "Ri" is average pore diameter of the barrier layer 25, it is preferred to satisfy any one of the following conditions (1) to (3).

$$Ps>Pi, \text{ and } Rs=Ri \quad (1)$$

$$Ps=Pi, \text{ and } Rs>Ri \quad (2)$$

$$Ps>Pi, \text{ and } Rs>Ri \quad (3)$$

By satisfying any one of these conditions, as described above, it is possible to obtain the barrier layer 25 capable of preventing the diffusion of the reactive substances and the contaminators into the porous layer 20. When the condition of Ps>Pi+10 (%) is satisfied, the mechanical strength of the heat insulating layer 2 can be improved as a whole by reinforcing the porous layer 20 with the barrier layer 25. In addition, from the viewpoint of more effectively preventing gas diffusion into the porous layer 20, it is preferred to satisfy the condition of Rs−0.5 nm>Ri. Ideally, it is preferred to satisfy both of the aforementioned two conditions.

In addition, to more effectively achieve the purpose of the present invention, the barrier layer 25 preferably has a thickness determined so as not to exceed a thermal diffusion length "D" (m) represented by the following equation.

$$D=(2\alpha i/\omega Ci)^{1/2}.$$

In this regard, "D" (m) is the thickness of the barrier layer 25, "αi" is thermal conductivity of the barrier layer, "Ci" is thermal capacity ((J/(m$^3$·K))) per unit volume of the barrier layer, and "ω" (=2πf (rad/s)) is angular frequency of temperature fluctuations caused in the heat generating layer 3. When the driving input waveform applied to the heat generating layer 3 is a sine wave, a frequency "f" (Hz) of ideal temperature fluctuations caused in the heat generating layer 3 corresponds to is equal to twice as large as the frequency of the sine wave.

For example, when it is desired to generate the pressure wave having a frequency of 60 kHz, the frequency of the driving input waveform can be set to 30 kHz. When "αi" of the barrier layer is approximately 1.55 [W/(m·K)], and "Ci" is approximately $1.01\times10^6$ [J/(m$^3$·K)], the thermal diffusion length "D" i.e., the thickness appropriate to heat transfer is approximately $D\approx2.85\times10^{-6}$ [m]=2.85 μm according to the above equation. Therefore, when the thickness of the barrier layer 25 is determined so as not to exceed 2.85 μm, the porous layer positioned under the barrier layer exhibits good heat insulating property.

By the way, it is needed that a temperature change is caused in the heat generating layer formed on the heat insulating layer in response to a change in electrical input energy. That is, to emit the sound wave having a prescribed frequency, it is needed to minimize the heat capacity of the heat generating layer, and improve thermal responsibility. For that purpose, the heat generating layer is formed to have a very thin thickness, e.g., a range of 10 to 200 nm, and more preferably 20 to 100 nm. Since it cannot be expected that such a thin heat generating layer provides an effect of shielding the surrounding medium (e.g., air), the shielding effect is improved by independently forming the barrier layer from the heat generating layer.

In addition, when at least one of the porous layer 20 and the barrier layer 25 is made of an electrical insulating material, it is possible reduce heat penetration rate, increase pressure-wave generation efficiency, and also suppress that a leakage current flows in the heat insulating layer 2 at the time of energization of the heat generating layer 3. As a result, the pressure wave having large sound pressure can be stably generated. The pressure-wave generation efficiency is a value defined as a ratio of sound pressure of the generated pressure wave relative to input electric power.

As an example of the electrical insulating material, it is explained about a case where the porous layer 20 is formed by porous silica. From the viewpoint of preventing that moisture in the air is adsorbed into pores of the porous layer 20 of porous silica, it is preferred that an average pore diameter of the porous layer is 5 nm or less. Thereby, it is possible to prevent an increase in volumetric heat capacity of the heat insulating layer 2 having the pores, and a reduction in pressure wave generation efficiency. In addition, since the moisture becomes hard to adsorb to the interior of the porous layer 20, it can be prevented that a leakage current flows through the adsorbed moisture, and the pressure wave having large sound pressure can be stably generated even in a high humidity atmosphere.

Next, a method of producing the pressure wave generator described above is explained. This production method mainly comprises the steps of forming the porous layer 20 on the substrate 1, forming the barrier layer 25 on the porous layer 20, forming the heat generating layer 3 on the barrier layer 25, and forming the pair of pads 4 on both end portions of the heat generating layer 3.

Figure 2:
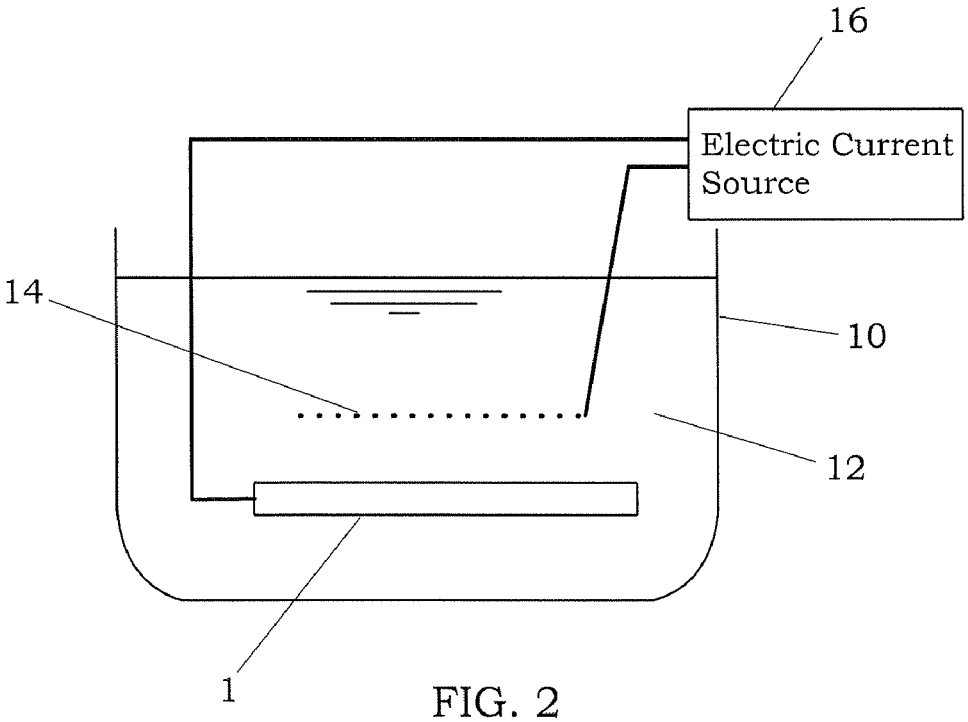
FIG. 2 is a schematic diagram showing the principle of an anodizing treatment.

It is preferred that the porous layer 20 is formed by performing an anodizing treatment to a predetermined surface region of the p-type single crystal silicon substrate 1. For example, as shown in FIG. 2, the anodizing treatment is performed by dipping an object to be treated, i.e., the silicon substrate 1 in an electrolytic solution 12 (e.g., a mixed solution of a 50 wt % hydrogen fluoride 6 aqueous solution and ethanol with a mixture ratio of 1.2:1) filled in a treatment vessel 10. In the treatment vessel 10, a platinum electrode 14 connected to an electric current source 16 is disposed in the electrolytic solution 12 so as to face a surface of the silicon substrate 1 where the porous layer 20 should be formed. The platinum electrode 14 is used as the cathode, and an electrode for energization is used as the anode. The anodizing treatment is performed to the surface of the silicon substrate 1 by flowing an electric current with a predetermined current density from the electric current source 16.

In addition, the porous layer 20 is preferably formed by forming a first porous layer P1 over a depth from the surface of the substrate 1, and then forming, adjacent to the first porous layer P1 in the substrate 1, a second porous layer P2 that is larger in at least one of porosity and average pore diameter than the first porous layer P1. In this regard, at least a part of the first porous layer P1 is used to form the barrier layer 25, as described later. It is particularly preferred to use the anodizing treatment to from the first and second porous layers (P1, P2). That is, after the first porous layer P1 is formed over the depth from the substrate surface by performing the anodizing treatment under a first condition, the second porous layer P2 is formed adjacent to the first porous layer P1 in the substrate 1 by performing the anodizing treatment under a second condition different from the first condition. The first and second conditions of the anodizing treatment are determined such that the first porous layer P1 has a structure where at least one of porosity and average pore diameter of the first porous layer is smaller than that of the second porous layer P2.

Figure 3A:
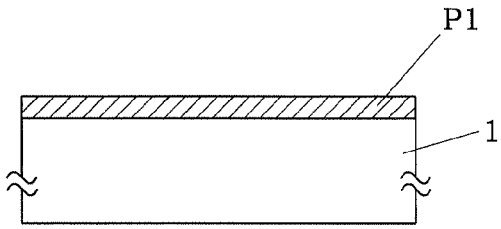
FIG. 3A is a schematic cross-sectional view of a first porous layer formed in a substrate.
Figure 3B:
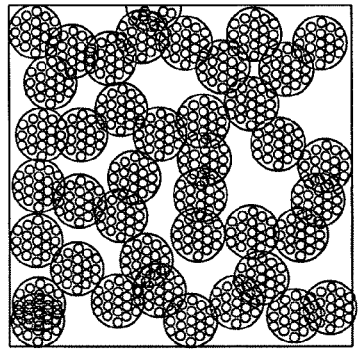
FIG. 3B is a schematic diagram showing a structure of the first porous layer.

Hereinafter, it is more concretely explained about the case of forming the first and second porous layers (P1, P2) by the anodizing treatment. When a first anodizing treatment is performed to the surface of the substrate 1 by flowing an electric current having a current density (e.g., 5 mA/cm$^2$) for a predetermined time period, the first porous layer P1 having a porosity and an average pore diameter is formed over a required depth from the substrate surface, as shown in FIGS. 3A and 3B.

Figure 4A:
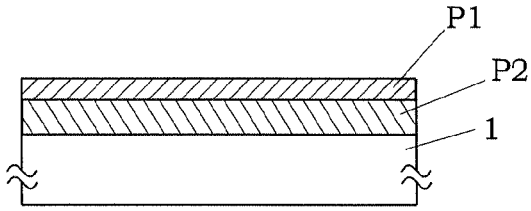
FIG. 4A is a schematic cross-sectional view of a second porous layer formed adjacent to the first porous layer in the substrate.
Figure 4B:
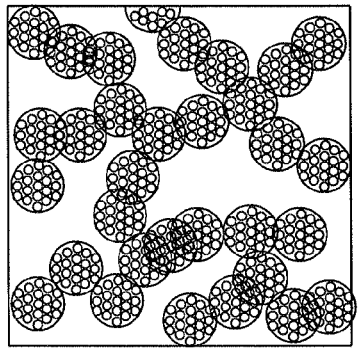
FIG. 4B is a schematic diagram showing a structure of the second porous layer.

Then, a second anodizing treatment is performed to the surface of the substrate 1 by flowing an electric current having a current density (e.g., 100 mA/cm$^2$) different from the first anodizing treatment for a predetermined time period, so that the second porous layer P2 is formed adjacent to the first porous layer P1 in the substrate 1 so as to be larger in at least one of porosity and average pore diameter than the first porous layer P1, as shown in FIGS. 4A and 4B. FIGS. 3B and 4B schematically show that the second porous layer P2 formed by the second anodizing treatment has a more porous structure than the first porous layer P1.

It is worthy of attention that the second anodizing treatment proceeds without substantially having an influence on the porosity and the average pore diameter of the first porous layer P1 formed by the first anodizing treatment, so that the second porous layer P2 having a desired thickness can be formed directly below the first porous layer P1. This is because the anodizing treatment preferentially proceeds at a fresh portion of the substrate 1, which the electrolytic solution contacts, and on the other hand hardly proceeds at the porous structure already formed by the anodizing treatment. Under the above treatment conditions, the thickness of the first porous layer P1 is 0.1 μm, and the thickness of the second porous layer P2 is 1.6 μm. The thickness of the substrate 1 used is 525 μm. These values are examples only, and therefore do not limit the scope of the invention. In addition, the current density and the treatment time are not specifically limited. For example, the current density can be appropriately set in a range of 1 to 500 mA/cm$^2$.

Figure 5:
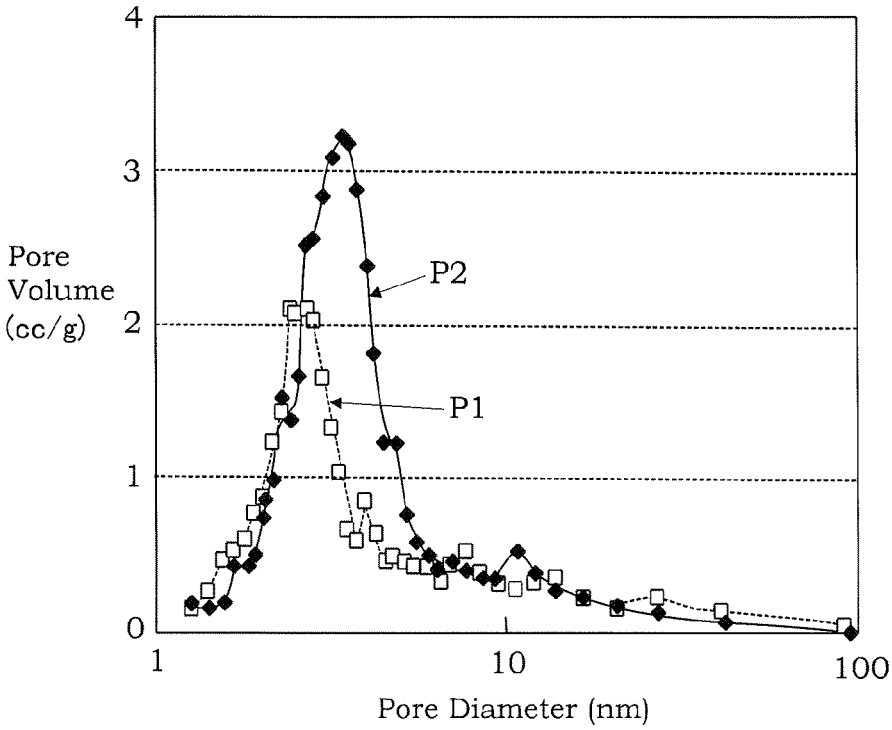
FIG. 5 is a graph showing relations between pore diameter and pore volume of the first and second porous layers.

FIG. 5 shows results of measuring pore diameter distribution by a gas adsorption method, with respect to each of the obtained first and second porous layers (P1, P2). The first porous layer P1 has a peak showing that there are a large number of pores in the vicinity of 2.73 nm of the pore diameter. On the other hand, the second porous layer P2 has a peak showing that there are a large number of pores in the vicinity of 3.39 nm of the pore diameter. Therefore, it can be understood that the first porous layer P1 is smaller in pore diameter than the second porous layer P2. In addition, as a result of measuring porosity by the gas adsorption method with respect to each of the first and second porous layers (P1, P2), the porosity of the first porous layer P1 is 64.5%, and the porosity of the second porous layer P2 is 75.8%. Thus, the first porous layer P1 is also smaller in porosity than the second porous layer P2.

Thus, when the first porous layer P1 is formed such that at least one of porosity and average pore diameter, and preferably both of porosity and average pore diameter of the first porous layer is smaller than that or those of the second porous layer P2, the barrier layer 25 suitable to achieve the purpose of the present invention can be formed by the subsequent step.

As another preferred embodiment of the step of forming the porous layer 20, the condition of the anodizing treatment may be continuously changed such that at least one of porosity and average pore diameter gently increases in the depth direction from the substrate surface. In this case, at least one of porosity and average pore diameter can be minimized at a surface layer portion of the obtained porous layer 20. In the subsequent step, the barrier layer 25 is formed at this surface layer portion.

Figure 6A:
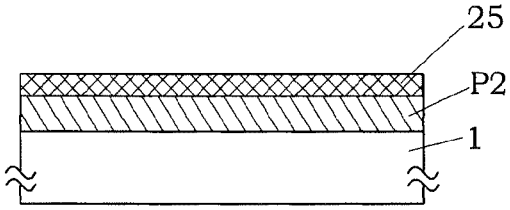
FIG. 6A is a schematic cross-sectional view of a barrier layer formed by performing a volume expansion treatment to the second porous layer.
Figure 6B:
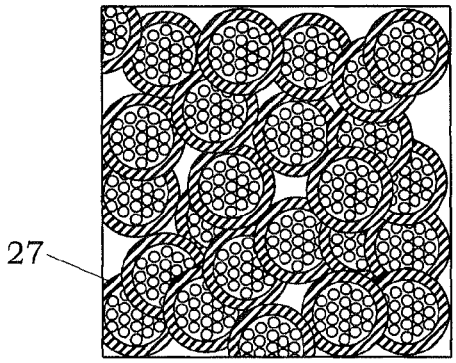
FIG. 6B is a schematic diagram showing a structure of the barrier layer.

Next, it is explained about the step of forming the barrier layer 25. The barrier layer 25 can be formed by a treatment of reducing at least one of porosity and average pore diameter, and preferably both of porosity and average pore diameter of the surface layer portion of the porous layer. As such a treatment, it is preferred to adopt a treatment of expanding the volume of the surface layer portion of the porous layer 20. For example, in the case of expanding the volume of the first porous layer P1 formed by the first anodizing treatment, a heat treatment can be performed to the first porous layer P1 in the presence of an oxidation gas. As shown in FIGS. 6A and 6B, the first porous layer P1 of porous silicon is volume expanded by oxidation, so that the barrier layer 25 is formed on the second porous layer P2. FIG. 6B schematically shows that the first porous layer P1 shown in FIG. 3B is changed to the barrier layer 25 with reductions in the number of pores and pore size by the volume expansion. In addition, a hatching area 27 shown in FIG. 6B corresponds to a volume expanded portion. Thus, the barrier layer 25 obtained by the volume expansion of the first porous layer P1 contains a silicon compound such as silicon oxide. The heat treatment conditions can be appropriately determined in consideration of parameters such as material of the porous layer to be volume expanded and thickness of the porous layer. For example, the first porous layer P1 can be volume expanded by oxidation in a high humidity and temperature atmosphere (temperature: 120° C., humidity: 85%). Alternatively, the first porous layer P1 may be heated at approximately 200° C. in the air.

As a remarkable point in the volume expansion treatment described above, since the volume expansion is achieved by heating in the presence of a reactive gas, most of the reactive gas (e.g., an oxidizing gas) supplied from the outside is consumed to oxidize the first porous layer P1 before entering into the second porous layer P2 through the first porous layer P1. In other words, according to this volume expansion, it is possible to form the barrier layer 25 by reducing at least one of porosity and average pore diameter preferentially in the first porous layer P1 without substantially changing the porosity and the average pore diameter of the second porous layer P2. As the porosity and the average pore diameter of the first porous layer P1 become smaller, the volume expansion can preferentially proceed in the first porous layer.

Figure 7:
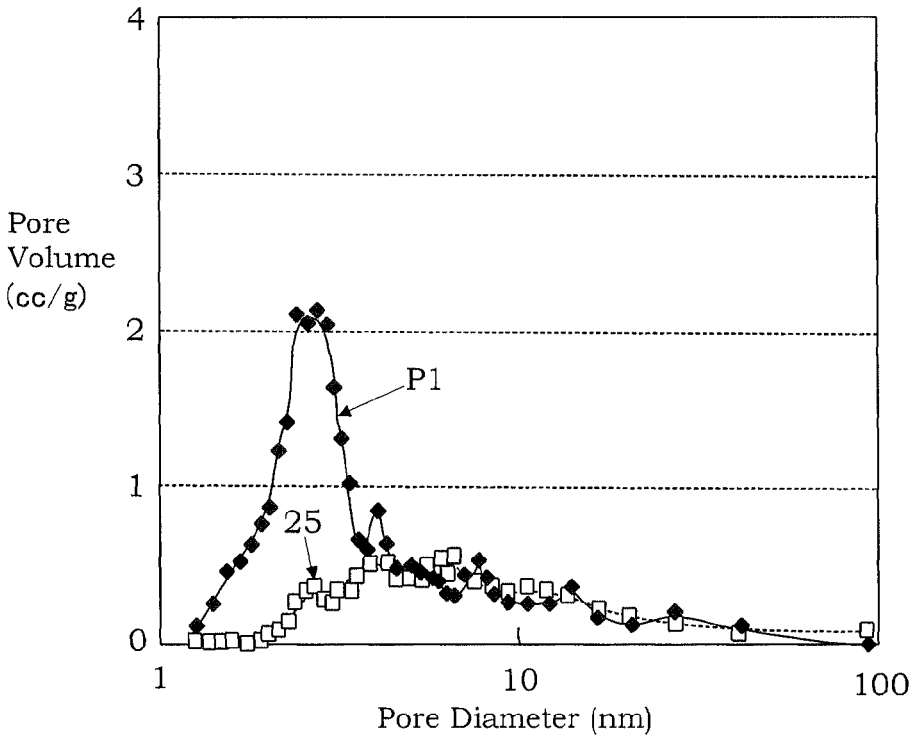
FIG. 7 is a graph showing relations between pore diameter and pore volume of the second porous layer and the barrier layer.

FIG. 7 shows relations between pore volume and pore diameter before and after performing the volume expansion treatment to the first porous layer P1, which were measured by a gas adsorption method. As described above (FIG. 5), the first porous layer P1 has a large number of pores in the vicinity of 2.73 nm of the pore diameter before the volume expansion treatment. On the other hand, in the barrier layer 25 formed by the volume expansion treatment, most of the pores having the pore diameter in the vicinity of 2.73 nm disappear. That is, it can be understood that the pore volume is considerably reduced, and most of the initially formed pores are sealed.

A purpose of forming the barrier layer 25 of the present invention is to prevent diffusion of reactive substances or contaminators contained in a medium (mainly, air) surrounding the pressure wave generator into the second porous layer P2, which functions as the porous layer 20 of the heat insulating layer 2. Therefore, it is not necessary to expand the entire volume of the first porous layer P1. In brief, the purpose can be achieved by expanding the volume of only a part (the surface layer portion) of the first porous layer P1. In addition, the volume expansion treatment is not limited to the case of heating in the presence of the oxidizing gas. Another reaction accompanied by the volume expansion is also available. For example, at least a part of the first porous layer P1 may be volume expanded by carbonization or nitrization, which is realized by heating in the presence of a carbonizing gas or a nitriding gas. In this case, the barrier layer 25 contains a silicon compound having chemical stability such as silicon nitride and silicon carbide. Alternatively, the volume expansion may be performed by heating in the presence of at least two kinds of gases selected from an oxidizing gas, a carbonizing gas and a nitriding gas. In this case, the barrier layer 25 may contain a silicon carbonitride or a silicon oxinitride.

According to the volume expansion treatment described above, there is an advantage of easily forming a homogeneous barrier layer without filling a sealing material in the surface layer portion of the porous layer 20 or the pores of the first porous layer P1. In addition, the barrier layer 25 formed by the volume expansion treatment is integrally formed with the second porous layer P2 of the porous layer 20. Therefore, as compared with a case where the barrier layer is formed on the porous layer 20 by use of a different material, it is possible to obtain an improved interface strength between the barrier layer 25 and the porous layer 20. Furthermore, the skeleton of the porous layer 20, which is lower in mechanical strength than single crystal silicon, can be reinforced by the barrier layer 25 formed by the volume expansion. As a result, there is a further advantage of improving the mechanical strength of the heat insulating layer 2 comprised of the porous layer 20 and the barrier layer 25.

In addition, the above-described treatment for expanding the volume of the first porous layer P1 may be performed by means of a gas diffusion through the heat generating layer after the formation of the heat generating layer on the condition that the heat generating layer is not damaged.

Thus, many advantages are obtained by the volume expansion treatment described above. However, the volume expansion treatment of the present invention is not limited to the case of heating in the presence of the reactive gas. For example, a part of the porous layer may be electrochemically oxidized in an electrolyte solution for oxidation. In this case, for example, a 1M sulfuric acid aqueous solution can be used as the electrolyte solution in place of the electrolytic solution 12 used to form the porous layer 20. The substrate having the porous layer is dipped in the treatment vessel 10 having the sulfuric acid aqueous solution therein. The substrate is used as the anode, and the platinum electrode 14 is used as the cathode. By flowing an electric current having a predetermined current density (e.g., 10 $mA/cm^2$), the part of the porous layer can be electrochemically oxidized. In this regard, the electrochemical oxidization can be finished when an increase in voltage between the anode and the cathode reaches or exceeds a predetermined value (e.g., 15V) determined so as to correspond to a desired thickness of the barrier layer. The electrolyte solution used to form the barrier layer is not limited to the above. Alternatively, a solution obtained by solving an oxidizing agent such as potassium nitrate in an organic solvent such as ethylene glycol may be used.

The same treatment apparatus used in the step of forming the porous layer is also used in the step of forming the barrier layer by electrochemically oxidizing the porous layer in the electrolyte solution. In brief, the formation of the barrier layer can be achieved by simply changing the electrolyte solution. Therefore, there is another advantage of reducing the production cost.

As a further modification of the step of forming the barrier layer 25, the barrier layer 25 may be formed by heat melting at least the surface layer portion of the porous layer 20 by use of a laser beam. That is, the barrier layer can be formed by means of laser annealing. In this case, by performing the treatment in an inter-gas atmosphere or in vacuum, it becomes possible to maintain the interiors of the pores of the porous layer in an inert-gas filled state or a reduced pressure state. In addition, since the barrier layer has a dense structure, it can function as a pore sealing layer for sealing the pores of the porous layer, and protecting the porous layer from the reactive substances or contaminators.

In addition, as another modification of the step of forming the barrier layer 25, the barrier layer may be formed by applying a paste-like sealing agent to the surface layer portion of the porous layer 20, and then pressurizing the applied sealing agent.

Figure 8:
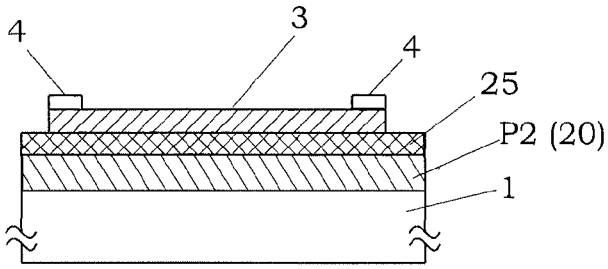
FIG. 8 is a schematic cross-sectional view showing a step of forming a heat generating layer and pads.

Next, the steps of forming the heat generating layer 3 and the pads 4 are briefly explained. As shown in FIG. 8, the heat generating layer 3 can be formed on a surface of the barrier layer 25 by means of spattering or vapor deposition with use of a metal mask. On the other hand, the pads 4 can be formed at predetermined positions on the heat insulating layer 3 by means of spattering and vapor deposition with use of a metal mask, as in the case of forming the heat insulating layer. In the present embodiment, the heat insulating layer 3 is formed by an iridium film having a thickness of 50 nm. The pads 4 are formed by an aluminum film having a thickness of 0.5 μm. These values are examples only, and therefore do not limit the scope of the invention.

Figure 9:
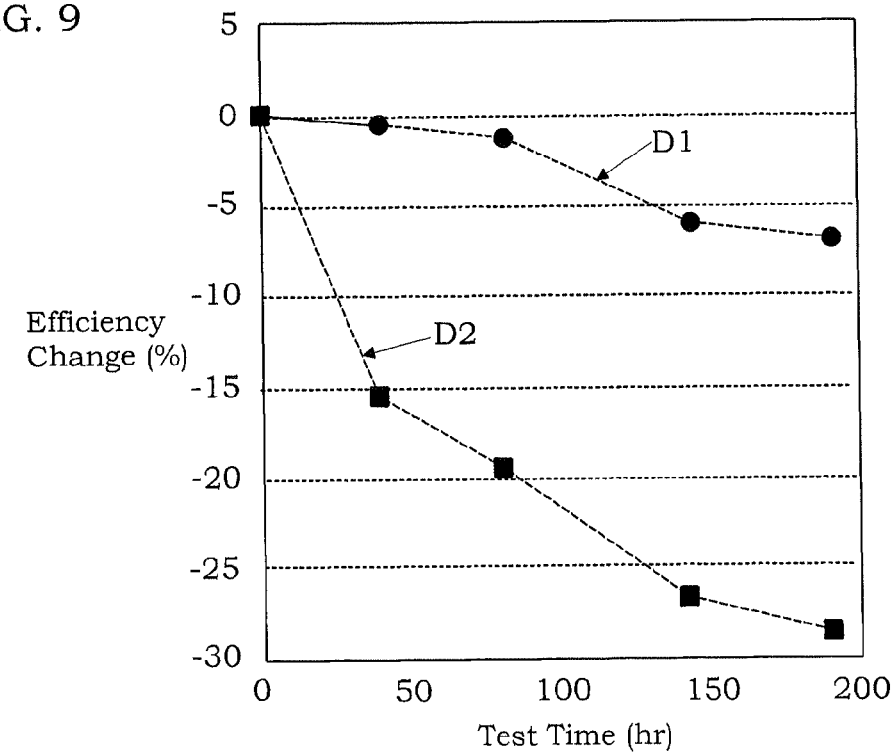
FIG. 9 is a graph showing output stability over time of the pressure wave generator having the barrier layer.

Next, an evaluation test performed to check an effect of the formation of the barrier layer on output stability over time of the pressure wave generator is introduced. In this evaluation test, the pressure wave generator (D1) of the present invention having the barrier layer 25 formed by expanding the volume of the first porous layer P1 and a comparative pressure wave generator (D2) having the heat insulating layer 2 formed by only the second porous layer P2 were used. Each of these devices was exposed to an atmosphere having a temperature of 120° C. and a humidity of 85%, and then an efficiency (=sound pressure (Pa)/input power (W)) was measured every predetermined period of test time. Results are shown in FIG. 9. As understood from this graph, the efficiency rapidly decreases in the comparative pressure wave generator (D2) as the test time advances. On the other hand, in the pressure wave generator (D1) of the present invention, a reduction amount of the efficiency becomes small, and the output stability over time is remarkably improved. In FIG. 9, "Efficiency Change" of the longitudinal axis is calculated by a mathematical formula of $[(\phi 2-\phi 1)/\phi 1]\times 100$, wherein "$\phi 1$" is the efficiency before the evaluation test, and "$\phi 2$" is the efficiency after the evaluation test.

Figure 10:
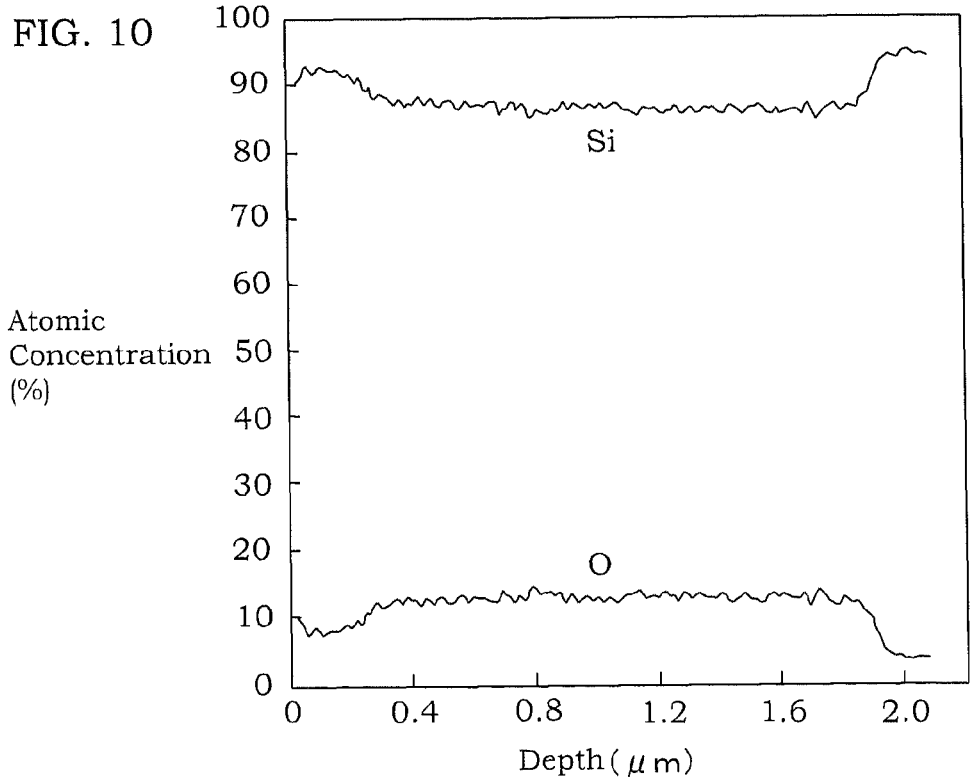
FIG. 10 is a diagram showing a result of analyzing the heat insulating layer of the pressure wave generator of the present embodiment before an evaluation test by use of Auger electron spectroscopy.
Figure 11:
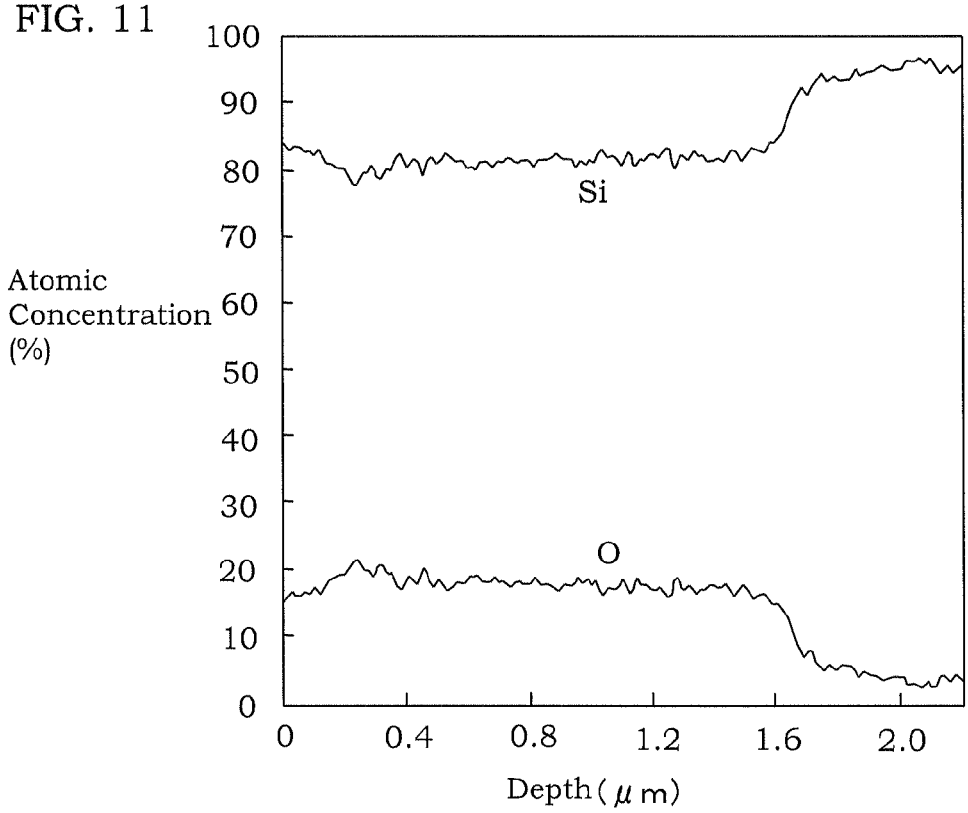
FIG. 11 is a diagram showing a result of analyzing the heat insulating layer of the pressure wave generator of the present embodiment after the evaluation test by use of Auger electron spectroscopy.
Figure 12:
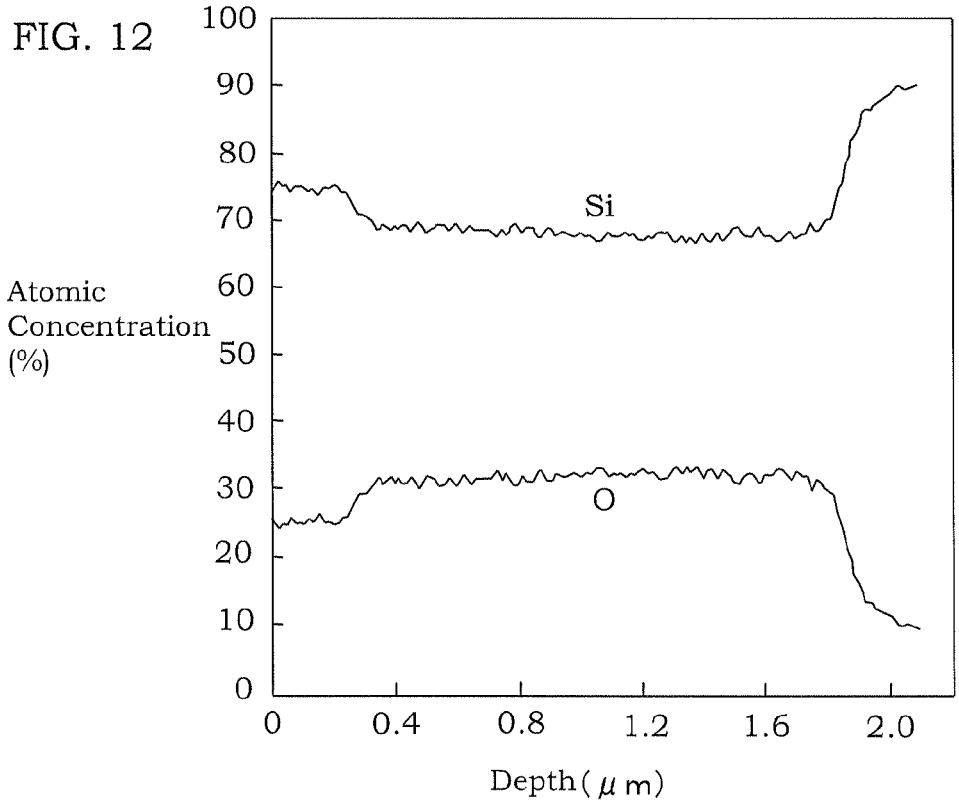
FIG. 12 is a diagram showing a result of analyzing a heat insulating layer of a conventional pressure wave generator after the evaluation test by use of Auger electron spectroscopy.

In addition, with respect to the pressure wave generator (D1), silicon (Si) and oxygen (O) distributions in the depth direction of the porous layer 20 of the heat insulating layer 2 before and after the evaluation test were measured by Auger electron spectroscopy. Measurement results are shown in FIGS. 10 A*nd* 11. Similarly, with respect to the comparative pressure wave generator (D2), the silicon (Si) and oxygen (O) distributions in the depth direction of the porous layer 20 of the heat insulating layer 2 before and after the evaluation test were measured by Auger electron spectroscopy. Measurement results are shown in FIG. 12. From these results, it can be understood that the pressure wave generator (D1) having the barrier layer 25 of the present invention has the capability of remarkably preventing the progression of oxidation of the porous layer 20, as compared with the comparative pressure wave generator (D2) not having the barrier layer.

In the above embodiment, it was explained about the case where the semiconductor material is used as the substrate material. Alternatively, a metal substrate having high thermal conductivity may be used. In this case, the porous layer such as a porous silica layer having higher heat insulating property than the substrate is formed as an electrical insulating layer as well as the heat insulating layer on the metal substrate, and then the barrier layer is formed on the surface layer portion of the porous layer to prevent the diffusion of moisture and contaminators.

INDUSTRIAL APPLICABILITY

Thus, according to the present invention, since diffusion of reactive substances such as oxygen and moisture in the air and impurities into the porous layer can be prevented by the formation of the barrier layer on the porous layer at a side facing the heat generating layer. As a result, it is possible to provide the pressure wave generator having excellent output stability over time. In addition, according to the production method of the present invention, the function of the barrier layer can be obtained by expanding the volume of a surface layer portion of the porous layer, and the mechanical strength of the heat insulating layer can be improved, as compared with the case where the heat insulating layer is formed by only the porous layer.

Therefore, the present invention has a high utility value by solving problems of the conventional thermally induced type pressure wave generator for generating a pressure wave such as ultrasonic wave without mechanical vibrations.

The invention claimed is:

1. A pressure wave generator comprising a substrate, a heat generating layer, and a heat insulating layer formed between said substrate and said heat generating layer, and configured to generate a pressure wave in a surrounding medium by a change in temperature of said heat generating layer, which is caused upon energization of said heat generating layer, wherein said heat insulating layer comprises a porous layer and a barrier layer formed between said porous layer and said heat generating layer, wherein said barrier layer has a structure where porosity and average pore diameter of said barrier layer are smaller than those of said porous layer, wherein said barrier layer has a porous structure, and at least a part of pores of said porous layer are communicated with pores of said barrier layer, and wherein said barrier layer is formed by expanding the volume of a part of said porous layer so that most of the pores in the barrier layer are sealed, thereby preventing diffusion of a component of said medium into said porous layer.

2. The pressure wave generator as set forth in claim 1, wherein said porous layer is made of silicon, and said barrier layer comprises a silicon compound.

3. The pressure wave generator as set forth in claim 2, wherein said silicon compound is at least one selected from silicon oxide, silicon carbide and silicon nitride.

4. The pressure wave generator as set forth in claim 1, wherein an inert gas is filled in said porous layer.

5. The pressure wave generator as set forth in claim 1, wherein an interior of said porous layer is held at a reduced pressure atmosphere.

6. The pressure wave generator as set forth in claim 1, wherein a thickness of said barrier layer is equal to or smaller than a thermal diffusion length (m) determined by $(2\alpha i/\omega Ci)^{1/2}$, wherein "$\alpha i$" is thermal conductivity of said barrier layer, "Ci" is thermal capacity($J/(m^3 \cdot K)$) per unit volume of said barrier layer, and when a driving input waveform applied to said heat generating layer is a sine wave, and a frequency "f"(Hz) of temperature fluctuations of said heat generating layer is equal to twice as large as a frequency of said sine wave, angular frequency of said temperature fluctuations is represented as "$\omega=2\pi f$(rad/s)".

7. The pressure wave generator as set forth in claim 1, wherein at least one of said porous layer and said barrier layer is made of an electrically insulating material.

8. The pressure wave generator as set forth in claim 7, wherein said electrically insulating material comprises silica.

9. A method of producing a pressure wave generator, wherein the method comprises the steps of:

forming a porous layer as a heat insulating layer on a substrate;

forming a barrier layer as the heat insulating layer on said porous layer; and forming a heat generating layer, for giving a thermal shock to a surrounding medium due to a change in temperature caused upon energization, on said barrier layer, wherein the step of forming said porous layer comprises the sub-steps of performing an anodizing treatment to said substrate to form a first porous layer over a depth from a surface of said substrate, and then performing said anodizing treatment to said substrate under a different condition to form a second porous layer adjacent to said first porous layer in said substrate, wherein conditions of said anodizing treatment are determined such that said first porous layer has a porous structure where porosity and average pore diameter of said first porous layer are smaller than those of said second porous layer, and wherein said barrier layer is formed by expanding the volume of at least a part of said first porous layer so that most of the pores in the barrier layer are sealed, thereby preventing diffusion of a component of said medium into said porous layer.

10. The method as set forth in claim 9, wherein said porous layer is formed by performing an anodizing treatment to said substrate, and a condition of said anodizing treatment is determined such that porosity and average pore diameter of said porous layer are gently increased in a depth direction from a surface of said substrate.

11. The method as set forth in claim 10, wherein said barrier layer is formed by expanding the volume of a surface layer portion of said porous layer.

12. The method as set forth in claim 9, wherein said barrier layer is formed by expanding the volume of a part of said porous layer.

13. The method as set forth in claim 12, wherein the part of said porous layer is heated in the presence of at least one of oxidizing gas, carbonizing gas and nitriding gas to expand the volume thereof.

14. The method as set forth in claim 12, wherein the part of said porous layer is electrochemically oxidized in an electrolyte solution to expand the volume thereof.

15. The method as set forth in claim 9, wherein the step of forming said porous layer comprises the sub-steps of forming a first porous layer over a depth from a surface of said substrate, and then forming a second porous layer adjacent to said first porous layer in said substrate such that porosity and average pore diameter of said second porous layer are larger than those of said first porous layer, and wherein said barrier layer is formed by a treatment of reducing porosity and average pore diameter of said first porous layer.

16. The method as set forth in claim 15, wherein said treatment is a treatment of expanding the volume of at least a part of said first porous layer.

* * * * *